United States Patent [19]

Visser

[11] 4,233,954

[45] Nov. 18, 1980

[54] CONCRETE PILE CUTTING DEVICE

[75] Inventor: Frederick J. Visser, Glen Rock, N.J.

[73] Assignee: Von Rohr Equipment Corp., Bloomfield, N.J. ; a part interest

[21] Appl. No.: 15,022

[22] Filed: Feb. 26, 1979

[51] Int. Cl.[3] ..... B28D 1/04

[52] U.S. Cl. ..... 125/14; 83/475; 144/34 R

[58] Field of Search ..... 125/14, 23 R; 83/474, 83/475; 144/34

[56] References Cited

U.S. PATENT DOCUMENTS

| | | | |
|---|---|---|---|
| 1,477,114 | 12/1923 | Finlayson | 83/745 |
| 1,645,924 | 10/1927 | Palmiginno . | |
| 2,079,864 | 5/1937 | Lansing | 125/14 |
| 2,454,992 | 11/1948 | Coleman | 57/241 S |
| 2,514,912 | 7/1950 | Thibodeaux | 125/14 |
| 3,396,713 | 8/1968 | Schuman | 125/14 |
| 3,675,972 | 7/1972 | Siomito | 299/41 |
| 3,688,615 | 9/1972 | Protze | 82/70.2 |
| 3,976,045 | 8/1976 | Coggins | 125/12 |
| 4,044,749 | 8/1977 | Bowen | 125/23 R |
| 4,144,867 | 3/1979 | Wachs | 125/14 |
| 4,180,047 | 12/1979 | Bertelson | 125/14 |

FOREIGN PATENT DOCUMENTS

| | | | |
|---|---|---|---|
| 545628 | of 1956 | Italy | 125/14 |

*Primary Examiner*—Harold D. Whitehead
*Attorney, Agent, or Firm*—David A. Jackson

[57] ABSTRACT

A portable concrete pile cutting device is disclosed which comprises a support collar adapted to be removably mounted in supported annular location about a concrete pile, at least one pile cutting assembly mounted for reciprocation on the collar, and means located on the collar for the support of the pile cutting assembly. The pile cutting assembly is adapted to travel in a straight line to form a cut in the concrete pile which runs generally transverse to the longitudinal axis of the pile. A method is also disclosed which comprises mounting a collar in rigid association with the concrete pile, mounting the cutting assembly on the collar so that the cutting means is adjacent the concrete pile, and thereafter moving the cutting assembly with the cutting means in operation across the pile to form a cut, which is of a depth less than that of the thickness of the concrete pile.

16 Claims, 11 Drawing Figures

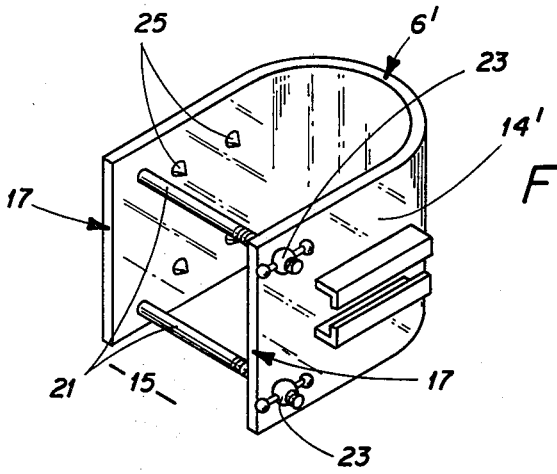
FIG. 7
FIG. 9
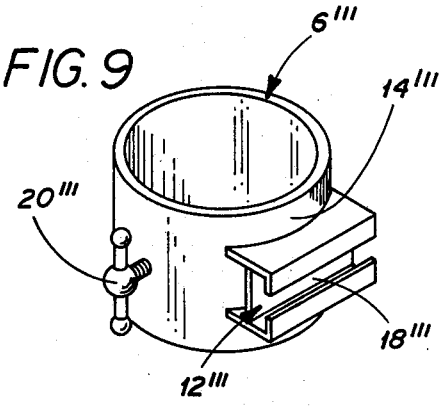
FIG. 8
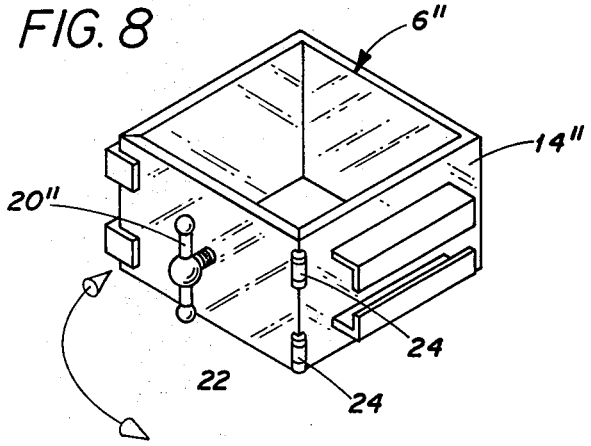
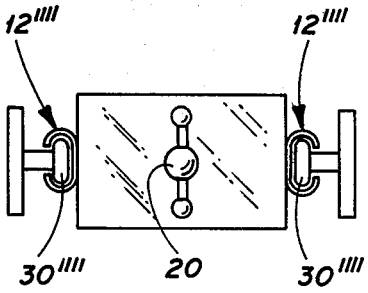
FIG. 10
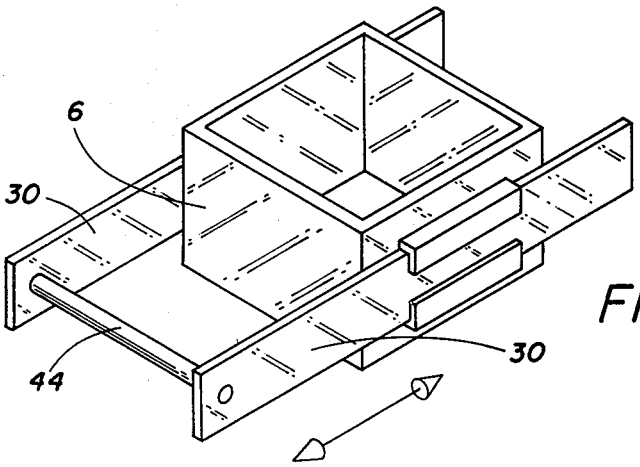
FIG. 11

CONCRETE PILE CUTTING DEVICE

BACKGROUND OF THE INVENTION

The present invention relates to a device for cutting concrete piles. More particularly, the present invention relates to a concrete pile cutting device which is adapted to cut prestressed concrete piles at a saving in both time and energy.

In the construction industry, concrete piles, more recently prepared from prestressed concrete have long been employed in the foundation of buildings and the like to serve as a primary load-bearing device. The piles are conventionally installed at the building site by being driven into the ground to a predetermined depth. Frequently, after the piles are driven, they can be seen to extend at varied heights out of the ground, as piles are manufactured to predetermined lengths which are frequently approximations of those lengths needed for a given application. Thus, it is necessary to sever the piles above a certain height generally the grade level of the construction site, to facilitate the uniform erection of the structure in question.

Concrete pile cutting has to date been accomplished by three methods comprising, respectively, demolition of the pile above the desired height, the manuel operation of hand supported motor driven circular saws employing either diamond blades or abrasive cutting edges, and the cumbersome frame and tracking system employing a cutting device utilizing a large blade that moves into the face of the pile on a plane perpendicular to its axis which endeavors to nearly completely sever the pile in one pass. Demolition requires cumbersome equipment and presents a problem in the instance of prestressed piles. The manual sawing technique is slow, arduous work, and the frame tracking system, by its size, requires manipulation by a crane and generates a substantial frictional component by the employment of the larger, thicker blade. Thus, both time and energy are lost in the employment of these well known methods.

Certain devices are known in the prior art for use in cutting stone, including concrete. These devices were utilized for cutting designs and the like in large slabs of stone such as marble, in the manner disclosed in U.S. Pat. Nos. 3,976,045 and 3,675,972. In U.S. Pat. No. 3,396,713 a device is disclosed for use in cutting doorways and window ways in concrete walls which utilizes straight saw guides attached to a concrete wall in which the saw may move linearly.

In addition to the foregoing references, other patents were noted which do not deal with the cutting of concrete piles, or of concrete material at all, but which were reviewed and noted as representative of the state of the art. Thus, U.S. Pat. No. 1,645,924 discloses a tree felling saw including two opposing rotating circular blades rotatably mounted about transverse carriages. U.S. Pat. No. 3,688,615 discloses a pipe cutting device in which a saw rides a guideway and a chain wrapped about a pipe and thereby moves in a circular path through the cutting sequence.

Applicant believes that the prior art presently known to him contains no suggestion of a device and associated method which alleviates the aforenoted difficulties, which are believed solved by the present invention.

SUMMARY OF THE INVENTION

In accordance with the present invention, a concrete pile cutting device is discloses which comprises a support collar adapted for removable, supported annular location about a concrete pile, at least one pile cutting assembly mounted for reciprocation on the collar, and means located on the collar for the support of the pile cutting assembly, wherein the pile cutting assembly is adapted to travel in a straight line to form a cut in the concrete pile generally transverse in direction to the longitudinal axis of the pile. The means for slidably supporting the pile cutting assembly comprises at least one rectilinearly extended track mounted on the exterior of the support collar in a direction generally transverse to the length of the concrete pile.

The support collar of the present invention is provided with adjustable locking means to vary the internal diameter of the collar to accommodate variations in the size of the piles. The pile cutting assembly comprises a rectilinear slide adapted to engage the track and a platform mounted on the slide provided for the support and securement of a means for cutting the concrete pile. The cutting means useful in the present invention comprises a circular saw which is disposed on the platform in spaced-apart relation to the support collar, whereby the maximum depth of cut is in a first embodiment less than the thickness of the concrete pile, and, preferably is less than 50% of the thickness of the pile.

The present invention further includes a method for cutting a concrete pile which comprises locating a support sleeve or collar about the pile in fixed supported engagement thereon, which support sleeve defines at least one rectilinearly extended track on its outer surface for the reciprocable support of a cutting assembly, placing the cutting assembly in slidable engagement within the track, activating the cutting means and guiding the cutting assembly including the cutting means across the concrete pile in a direction generally transverse to its length, to form a cut in the pile which is of a depth less than that of the thickness thereof. In an alternate embodiment, the depth of the cut is less than 50% of the thickness of the pile, and the foregoing method comprises the sequential engagement and cutting of the pile on the opposite lateral surfaces thereof to provide two juxtaposed cuts, each of a depth less than 50% of the thickness of the pile, whereby the pile may afterward be severed in the plane of the cuts.

The present invention is advantageous in that the cutting means comprising a circular concrete saw may employ cutting blades of reduced thickness and radius with the result that friction encountered in the curring operation is diminished. Accordingly, the useful life of the cutting blades is extended, and the reduction in friction during the cutting operation reduces cutting time and energy.

The device of the present invention is simple to manufacture and operate for ease in mounting and removal from the concrete piles without the need of cumbersome auxiliary machinery or strenous physical effort.

Accordingly, it is a principal object of the present invention to provide a device for cutting concrete piles which substantially reduces the time and physical effort required for pile cutting.

It is a further object of the present invention to provide a concrete pile cutting device as aforesaid which is portable and is supported in use by the concrete pile.

It is a yet further object of the present invention to provide a concrete pile cutting device as aforesaid which exhibits greater durability and service life, with a reduced frequency and cost of maintenance.

It is a yet further object of the present invention to provide a concrete pile cutting device as aforesaid which is of simple and inexpensive construction.

It is a yet further object of the present invention to provide a method for cutting concrete piles employing the pile cutting device as aforesaid, which method is characterized by improved ease and economy in the cutting of concrete piles.

Other objects and advantages will become apparent to those skilled in the art from the consideration of the ensuing description which proceeds with reference to the following accompanying drawings.

BRIEF DESCRIPTION OF THE DRAWINGS

FIGS. 7, 8 and 9 are perspective views showing alternate embodiments of the support collar of the present invention.

FIG. 10 is a side view showing an alternate embodiment of the concrete pile cutting assembly and corresponding support means.

FIG. 11 is a schematic view in perspective illustrating a further embodiment of the present invention.

DETAILED DESCRIPTION OF THE INVENTION

In accordance with the present invention, the foregoing objects and advantages are readily attained.

Figure 1:
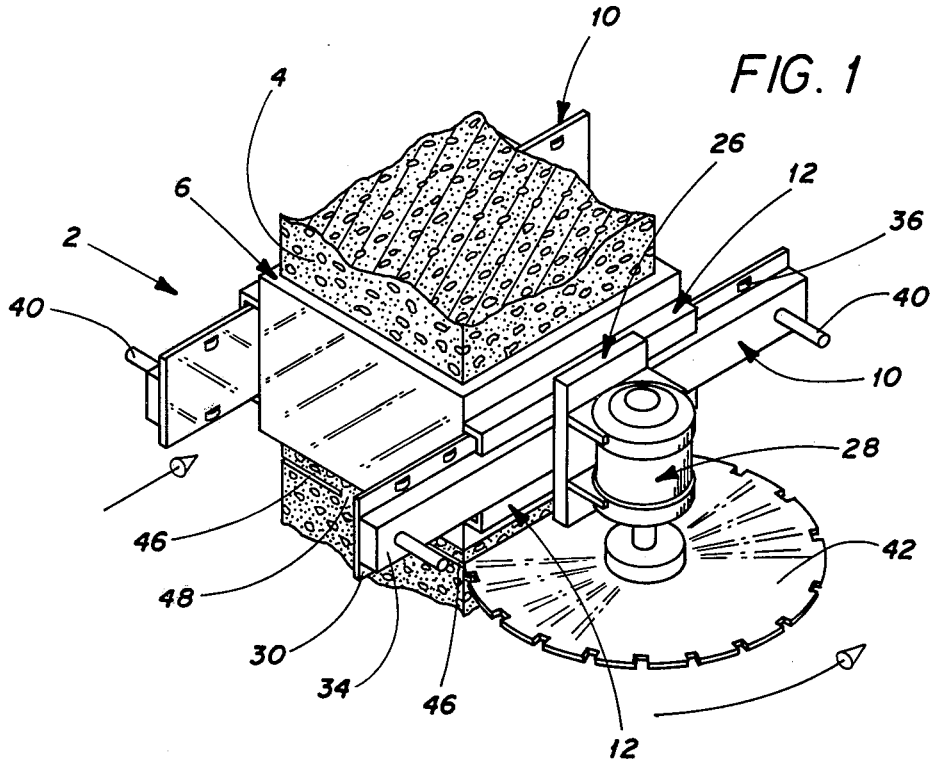
FIG. 1 is a perspective view of the device of the present invention in operating position on a concrete pile.
Figure 2:
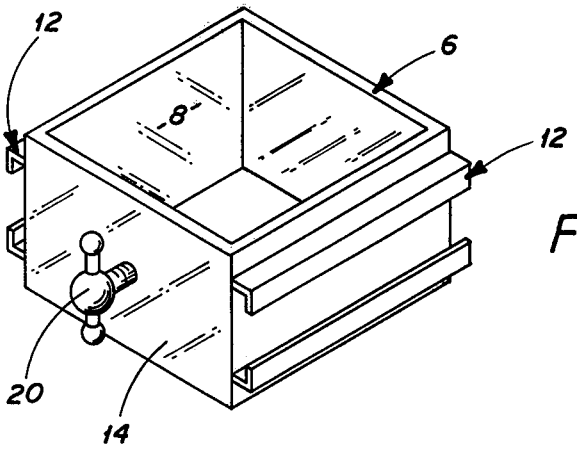
FIG. 2 is a perspective view of a support collar in accordance with the present invention.

Referring now to the figures, wherein like numerals designate like parts throughout, and particularly to FIG. 1, a portable concrete pile cutting device 2 is disclosed in operative engagement with a concrete pile 4 in a manner illustrating the pile cutting operation. Pile cutting device 2 is seen to comprise a support collar or carriage 6 which devices a generally columnar internal area 8, as illustrated in FIG. 2, which facilitates the mounting of collar 6 in supported annular disposition about pile 4. Device 2 further includes a concrete pile cutting assembly 10 which is slidably mounted for reciprocation in communication with collar 6 by support means comprising rectilinearly extended track 12 mounted exteriorly on collar 6. Track 12 as illustrated, appears to extend at a right angle to the axis of pile 4; however, it may vary from perpendicular and still be generally transverse to the axis of the pile. Thus, in the instance where piles known as angle or batter piles are installed, the plane containing the longitudinal dimension of track 12 is generally in parallel relation to the surface of the ground, and may appear askew with respect to the axis of pile 4.

As noted earlier, the concrete piles presently employed in construction vary substantially in cross-sectional shape and, accordingly, may be round, rectangular or square. Further, the piles are conventionally prepared primarily of concrete and may include aggregate material together with prestressed wire rope cables, straight or coiled wire, or a combination thereof. It is this latter construction, combining the strengthening effects of the wire prestressing that poses the difficulty in the cutting of the piles into conformity with the grading of the construction site. As noted above, cutting means such as concrete saws and the like as conventionally employed, tend to wear out quickly due to the intense frictional component and resistance engendered by the construction of the pile. Thus, heavy duty saws have been employed which, because of the nature of the cutting work, must by physically supported for extended periods of time to slowly cut through the pile. This cutting technique, as noted earlier, possesses its shortcomings from the standpoints of equipment costs, physical exertion and time consumption due to such an operation. In view of the above, the apparatus and associated method of the present invention are believed to effect a substantial economy in all of the above regards.

Referring now to FIG. 2, collar 6 is illustrated as an essentially rectangular structure comprising a surrounding wall 14, which defines an internal area comprising tunnel 8 for the reception of the concrete pile. In operation collar 6 is placed in fixed annular engagement with pile 4, so that pile 4 supports collar 6, and therefore, device 2. The reliance of the present device upon the concrete pile for support eliminates the additional support structure which makes conventional pile cutting apparatus costly and time-consuming to operate.

As illustrated in FIG. 2, collar 6 is an integrated structure, and wall 14 defines in cross-section a continuous, circumference comprised of integral planar elements. In an alternate embodiment shown in FIG. 7, however, wall 14' may be circumferentially discontinuous and any define an opening having a lateral or width dimension of a size sufficient to permit collar 6' to be placed directly in position on the concrete pile, without having to place the collar over the top of the pile and slide it into position. Referring to FIG. 7, wall 14' is discontinuous and describes a U-shaped cross-section defining an opening 15 for the reception of the concrete pile. Wall 14' thus defines approximately parallel edges 17 and a closure means, comprising in the figure connecting bolts 21 and mating nuts 23 which are installed after collar 6' is positioned against the pile, and tightened to hold collar 6' securely in placed. Collar 6' is held in fixed position against the pile by the frictional engagement provided by securement means comprises teeth 25 which grip the pile when the bolts and nuts are sufficiently tightened.

In a further embodiment shown in FIG. 8, collar 6'' may have a discontinuous wall 14'' which employs a closure means comprising a hingable release member such as door 22 which pivots between an open and a closed position to allow collar 6'' to be mounted and removed from the concrete pile. Door 22 as illustrated is thus provided with hinges 24, as well as a latch, not shown, which would hold door 22 in the closed position.

As noted with reference to the collar of FIG. 7, means for securing the collar in fixed engagement with the concrete pile is provided, as the collar relies on the concrete pile for its support during the operation of the device of this invention.

Figure 4:
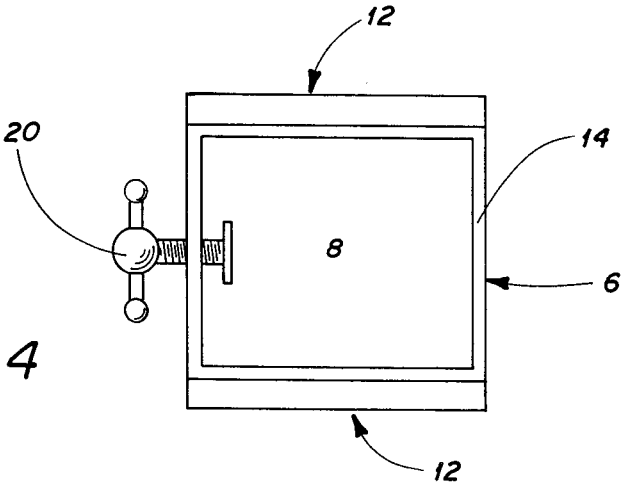
FIG. 4 is a top view of the support collar of FIG. 2 illustrating the adjustable locking means mounted therein.

Referring now to FIG. 4, collar 6 employs a securement means comprising an adjustable locking means illustrated herein as located in wall 14 which serves to adjust the internal diameter of collar 6 for locking engagement with concrete piles of varying diameter. The locking means is illustrated in FIG. 4 as comprising a screw type adjustment 20 mounted for radial reciprocating within wall 14, which in operation abuts against the circumference of the pile to secure collar 6 in position. The screw type adjustment 20 is illustrated, though it is contemplated that other adjustment means comprising, for example, shims or the like, may be employed which would serve to secure collar 6 in position against the pile. The invention is accordingly not believed to be limited to the adjustment means illustrated herein but rather contemplates a variety of such means within its spirit and scope.

The support collar of the present invention may vary in cross-sectional shape to account for variation in the cross-section of concrete piles. Thus, as illustrated in FIG. 9, collar 6''' may define an ovoid or circular cross-sectional configuration, as defined by wall 14'''. It is therefore apparent that the wall of collar 6 may vary substantially in configuration, within the scope of the present invention, to account for variations in the cross-sectional configuration of the concrete piles to be cut, and therefore the invention should not be construed as limited to the collar configurations illustrated herein.

Returning to FIG. 2, collar 6 is seen to define on the exterior surface of a portion of wall 14 a rectilinearly extended track 12 comprising as illustrated generally L-shaped brackets 16 which as indicated above extend in rectilinear fashion to provide support for pile cutting assembly 10 in the manner illustrated in FIG. 1 and discussed in further detail hereinbelow. An important feature of the present invention is the extension of track 12 in rectilinear fashion and approximately tangential relation to the circumferential surface of the concrete pile. Thus, in operation, the cutting assembly of the present invention serves to form a cut which passes linearly through the pile from one side thereof, rather than traveling around the entire circumference of the pile, in the manner of conventional pipe cutting apparatus. The linear extension of track 12 is retained in the embodiment of FIG. 9 wherein track 12''' includes a straight backing plate 18''' which provides support for cutting assembly 10 to facilitate its straight line movement.

Figure 3:
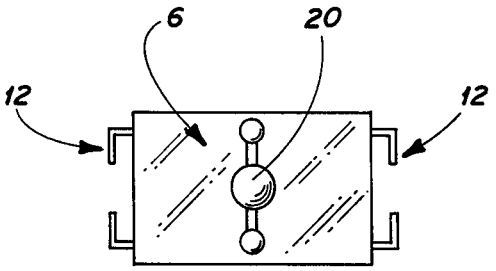
FIG. 3 is a side view of the support collar of FIG. 2 illustrating the pile cutting assembly support means of the present invention.

Referring further to the figures, and particularly to FIGS. 3 and 10, the track of the present invention defines an essentially C-shaped cross-sectional configuration which provides support and guidance for the reciprocation of the cutting assembly. Track 12 may vary in cross-sectional configuration from the L-shaped brackets 16 shown in FIGS. 1 and 2, to the rounded configuration illustrated by track 12'''' in FIG. 10, without departing from the spirit or scope of the present invention. In the illustration of FIG. 10, track 12'''' is closely fitted with a corresponding slide 30''''forming a part of the pile cutting assembly, discussed hereinbelow, to maintain the linear movement of the cutting assembly and the plane of cut perpendicular to the axis of the pile.

Figure 5:
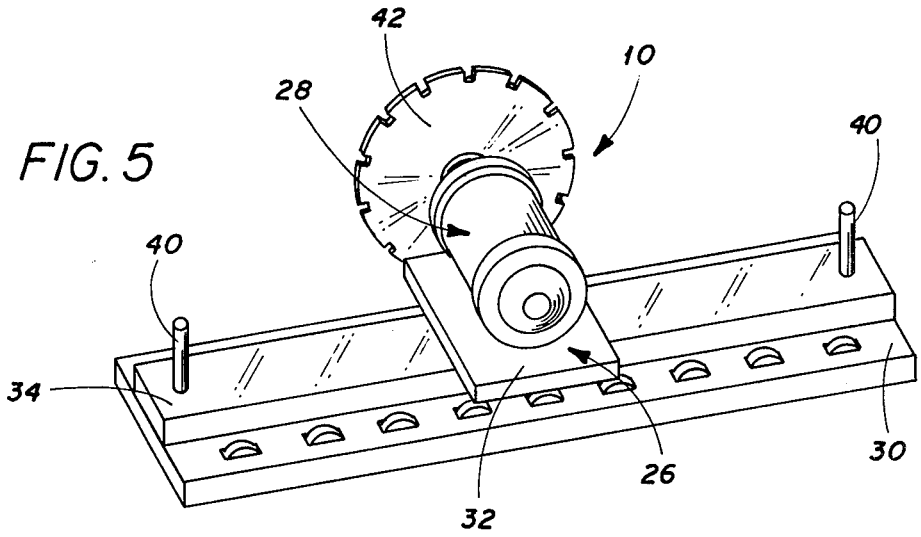
FIG. 5 is a perspective view of the pile cutting assembly of the present invention.
Figure 6:
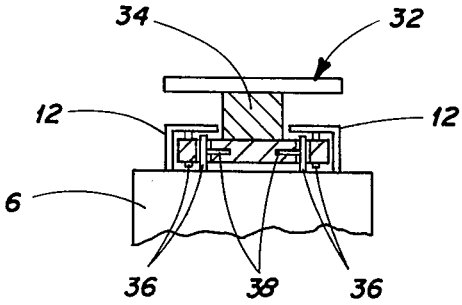
FIG. 6 is a fragmented side view partly in section showing the cooperation between the pile cutting assembly and the support means therefor.

Referring now to FIGS. 1, 5 and 6, concrete pile cutting assembly 10 of the present invention is seen to comprise a longitudinally extended linear cutter support 26 which, as noted earlier, is adapted to reciprocate within track 12 to transport the cutting means 28 across the concrete pile. Cutter support 26 comprises a rectilinearly extended slide 30 on one side of which is centrally mounted a cutting means platform 32. Referring now to FIG. 6, platform 32 is located in spaced-aparat disposition from slide 30 by the provision of a pedestal 34 so that platform 32 does not abrade against the outer surfaces of track 12 during operation. As noted earlier, slide 30 is adapted for slidable reciprocation within track 12 which may, in one embodiment of the invention as illustrated in FIGS. 1 and 6, be augmented by rollers 36 provided on axles 38 shown in FIG. 6 to be journaled within slide 30. Naturally, the movement of slide 30 is made easier by the employment of rollers or cam followers such as 36, however, it is to be understood that the invention is not limited thereto, but rather encompasses the slidable movement of cutting assembly 10 within tracks 12.

The cutting assembly of the present invention may be moved in a variety of ways, and, as illustrated in FIGS. 1 and 5, manual movement is facilitated by the provision of handles 40 which extend away from colar 6 and are located on opposite ends of longitudinally extended pedestal 34. Though not illustrated herein, the present invention contemplates the employment of motorized conveyance of pile cutting assembly 10 by, for example, the employment of a pinion gear in conjunction with a rack provided on the peripheral edge of platform 32, which pinion gear would then be attached to an appropriate motor or the like. Such an arrangement is disclosed in U.S. Pat. No. 3,396,713 to Shuman, the pertinent disclosure of which is incorporated herein by reference.

The cutting means of the present invention is schematically illustrated in FIGS. 1 and 5, and may comprise a circular concrete saw, a wide variety of circular saws suitable for use in cutting concrete are known and may be illustrated, and the invention contemplates their use without limitation within its scope. Circular saws useful herein may includes those saws that possess a light weight and a high torque rating. In a preferred embodiment, the saws may possess a torque rating ranging from about 27 foot-pounds at 1200 rpm to about 54 foot-pounds at 3600 rpm.

The employment of a particular typeof saw blade is significant as the present invention proposes to cut into the concrete pile along one face thereof in a plane perpendicular to the axis of the pile at a depth, however, which is less than the thickness of the pile, and in a preferred embodiment, which is less than 50% of such thickness. This type of cut may be accomplished using a thinner blade of lesser radius, nonetheless, having the strength and sharpness requisite to provide a rapid, clean cut through both the concrete and the metal comprising the pre-stressed concrete pile. The prior art cutting apparatus which utilized a blade having a larger thickness and diameter, resulted in costly maintenance and frequent breakdowns. The cutting means of the present invention, by contrast, exhibits a greater useful lefe and accomplishes the cutting operation in less time.

As noted above, cutting means 20 preferably comprises a high horsepower motor. The type of motor, however, is not critical and, therefore, the present device may employ pneumatic motors, air-driven motors and gasoline-powered motors, hydraulic motors and electric motors. Likewise, the blades useful in accordance with the present invention may comprise diamond saw blades characterized by the provision of diamond chips along the periphery thereof, as well as conventional abrasive blades used in concrete operations, the only limitation residing in the thickness of the blade employed.

Referring again to FIG. 1, the cutting assembly of the present invention is shown in operation and blade 42 is shown prceeding through pile 4 in a direction and plane perpendicular to the axis of the pile. Likewise, as illustrated, the disposition of blade 42 is relative to collar 6 is such that the resulting depth of cut is slightly less than 50% of the thickness of pile 4. As will be discussed later on with reference to the method of the present invention, employment of the preferred cutting depth on opposite circumferential sides of the pile yields a pile cut leaving a central longitudinal section of attachment which may then be broken by minimal physical force after the cutting operation is completed to finally sever the pile.

Referring again to the figures, and particularly to FIGS. 1–4, 10 and 11, the device of the present invention has been illustrated as provided with two extended tracks located in parallel opposition on outer surfaces of the wall. Parallel tracks are provided to facilitate the sequential cutting discussed above, wherein pile cutting assembly 10 may be mounted and moved through a first track 12, then removed and run through the opposite track 12 to effect the cut illustrated in FIG. 1. In the instance, however, where the device of the present invention contemplates a depth of cut greater than 50% of the thickness of the pile, such as, for example, a cut depth of 80–90%, only one track 12 may be employed and therefore necessary. In the preferred embodiment illustrade in FIGS. 1, 10 and 11, a pair of concrete pile cutting assemblies 10 may be provided to effect the simultaneous formation of the juxtaposed cut lines as illustrated in FIG. 1. When two cutting assemblies are used in parallel in this manner, an obvious economy in cutting time is achieved.

Referring now to FIG. 11, a further embodiment of the present invention for use in conjunction with the operation of plural pile cutting assemblies comprises the provision of linkage 44 illustrated schematically as a bar or the like which is affixed to the juxtaposed ends of slides 30 to permit a single individual to manually move the parallel assemblies simultaneously through the pile to form the cuts illustrated in FIG. 1. Thus, whereas the apparatus illustrated in FIG. 1 would require that each cutting assembly be separately guided by an individual worker, the linkage illustrated in FIG. 11 would permit one person to simultaneously guide both cutting assemblies.

The present invention also includes a method for cutting a concrete pile which comprises locating support collar 6 in annular disposition about a concrete pile and in fixed position thereagainst, activating the cutting means comprising the concrete cutting saw, and guiding the cutting assembly across the circumference of the pile to form a cut within the pile lying in a plane perpendicular to the axis of the pile, which cut has a depth less than the diameter of the pile. In one embodiment of operation, collar 6 may be lowered over pile 4, as described earlier, and then tightened against the pile by use of the screw type adjustment 20. After collar 6 is securely mounted on pile 4, the cutting assembly 10, comprising slide 30, cutter support 26 and cutting means 28 mounted thereon is mounted in track 12 by the insertion of one end of slide 30 therein and movement of slide 30 to position cutting means 28 adjacent pile 4. The cutting means which, as noted earlier, may preferably comprise a concrete circular saw, is then started and the cutting assembly is guided into contact with pile 4 along track 12 to form the perpendicular cuts 46 illustrated in FIG. 1. Upon completing its travel across pile 4, cutting assembly 10 is then removed from track 12. The cutting operation is over in the instance where the depth of cut is slightly less than the entire thickness of the pile. If the device of the present invention is utilized as illustrated in FIG. 1, collar 6 has been fastened to the portion of pile 4 that is to be removed and, accordingly, must itself be removed before the pile is finally severed. In the instance, however, wherein collar 6 is secured to the pile below the contemplated cut line, the collar need not be immediately removed and, upon completion of the cut, the portion of the pile standing above the cut line may merely be hit with a hammer or the like to fracture the remaining connective portion and to cause the upper portion of the pile to break and fall off.

In the illustration in FIG. 1, wherein the depth of cut is less than 50% of the thickness of the pile, the method of the present invention includes the repetition of the mounting, activation, and movement of cutting assembly 10 through parallel, opposed track 12 residing on opposite sides of pile 4. Upon completion of this second cutting sequence, a central connective portion 48 remains between the segements of pile 4 which may then be fractured in the manner disclosed above to cause the upper portion of pile 4 to break away from the lower portion. Further, in the instance where plurally parallel cutting assemblies 10 are employed, either individually or utilizing linkage 44 as illustrated, the cutting sequence is accomplished simultaneously, and upon the withdrawal of cutting assemblies 10 from tracks 12, the upper portion of the pile can be severed as above described.

As noted earlier herein, collar 6 may be modified to provide an opening and a complementary closure means as shown and described with reference to FIGS. 7 and 8, permitting collar 6 to be mounted and removed from pile 4 without raising or lowering the collar over the pile. In the instance where a collar bearing this modification is employed, the attachment and removal of collar 6 is modified from that described above to omit raising and lowering of the collar into position.

The pile cutting device of the present invention is preferably prepared from materials having strength sufficient to withstand the rigors of the concrete pile cutting operation. Thus, for example, the support collar, slide, pedestal and platform are preferably constructed from a metal such as tempered steel or the like which will provide the strength and stress resistance necessary to achieve durability and service with accuracy and consistency of operation. Naturally, the invention is not limited to the construction of the device from the foregoing metal, but rather, is intended by its scope to include all materials possessing the aforenoted strength and stress resistance requisite from employment in a pile cutting operation.

The device and corresponding method of the present invention are believed to comprise a simple and inexpensive solution to the problems faced in the cutting of concrete piles. As noted earlier, the device of the present invention is easily manufactured and simply operated, and the operation time is greatly reduced from that conventionally experienced in the field. Further, the size of the blades and the power of the saw motors used in accordance with a preferred embodiment of the present invention contribute to the speed of the cutting operation and also provided increased useful life in service with corresponding reductions in equipment replacement and service costs.

It is to be understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within the spirit and scope as defined by the claims.

I claim:

1. A portable device for cutting a concrete pile which comprises:

a collar adapted for annular supported disposition about said concrete pile, said collar comprising an outer wall defining a tunnel for the reception of said concrete pile, said wall possessing a discontinuous cross-sectional circumference that defines an opening for the lateral placement of said collar about said pile, said collar further comprising closure means attached to said wall for securing said collar in tensioned abutment with the outer surface of said pile;

means attached to said collar for the support of a pile cutting assembly, said pile cutting assembly support means comprising paired, parallel tracks, said tracks mounted in diametric opposition on said outer wall, each of said tracks defined by complementary, parallel brackets, said brackets extending in a longitudinal direction transverse to the axis of said collar, said brackets cooperating with said collar to define in cross-section an essentially C-shape;

at least one planar pile cutting assembly removably mounted in slidable disposition within one of said tracks, said pile cutting assembly comprising a planar, rectilinearly extended slide removably reciprocable within said tracks, a cutting means platform disposed medially along said slide to receive and hold a cutting means in fixed disposition thereon, and a cutting means comprising a rotating circular saw disposed in spaced-apart relation to said collar and adapted to form a cut in said pile having a depth less than the thickness of said pile, wherein said pile cutting assembly is free to pass through said track, and is removable therefrom, and said cutting means passes tangentially adjacent said pile and forms a cut in said pile generally transverse and perpendicular to the longitudinal axis thereof.

2. The device of claim 1 wherein said closure means comprises a door hingably mounted on said collar and adapted to pivot radially outward to permit placement of said collar about said pile.

3. The device of claim 1 further including securement means associated with said wall to hold said collar in fixed position on said pile.

4. The device of claim 1 including securement means comprising an adjustable locking means mounted in said wall to adjust the internal area defined in said wall to securely engage said collar upon said pile.

5. The device of claim 4 wherein said adjustable locking means comprises at least one screw-type adjustment mounted within said wall and adapted to reciprocate radially into and out of contact with said pile.

6. The device of claim 1 further including securement means comprising at least one tooth disposed on said wall and adapted to grippingly engage the outer surface of said pile when said collar is placed therearound.

7. The device of claim 6 wherein said closure means is adjustable in size to adjust the cross-sectional internal area defined by said wall to secure said collar on said pile.

8. The device of claim 1 further including rollable movement means associated with said slide to reduce friction between said slide and said track during the movement of said pile cutting assembly.

9. The device of claim 8 further including actuating means for moving said slide within said track.

10. The device of claim 9 wherein said actuating means comprises handles projecting from opposite ends of said slide in a direction away from said collar to facilitate the manual movement of said pile cutting assembly.

11. The device of claim 1 wherein said saw possesses a torque rating ranging from about 27 foot-pounds at 12 rpm to about 45 foot-pounds at 3600 rpm.

12. The device of claim 1 wherein said saw employs an electric motor.

13. The device of claim 1 wherein said cutting means further comprises a diamond-tipped circular saw blade.

14. The device of claim 1 wherein said cut depth is less than 50% of the thickness of said pile.

15. The device of claim 1 wherein two pile cutting assemblies are provided, each of said assemblies mounted respectively within one of said tracks, said pile cutting assemblies adapted to form parallel juxtaposed cuts in said pile.

16. The device of claim 15 wherein said pile cutting assemblies comprise rectilinearly extended cutting means supports, said supports in turn comprise longitudinally extended slides adapted to reciprocate within the said tracks, and said slides are provided at one end thereof with a transverse linkage extending therebetween, said linkage facilitating the simultaneous movement of said slides and the corresponding respective pile cutting assemblies to form parallel cuts within said pile.

* * * * *